US009683430B1

(12) United States Patent
Kuykendall

(10) Patent No.: US 9,683,430 B1
(45) Date of Patent: Jun. 20, 2017

(54) GAS-LIFT PLUNGER

(71) Applicant: EPIC LIFT SYSTEMS LLC, Fort Worth, TX (US)

(72) Inventor: Schuyler Kuykendall, Granbury, TX (US)

(73) Assignee: Epic Lift Systems LLC, Fort Worth, TX (US)

( * ) Notice: Subject to any disclaimer, the term of this patent is extended or adjusted under 35 U.S.C. 154(b) by 0 days.

(21) Appl. No.: 15/354,749

(22) Filed: Nov. 17, 2016

Related U.S. Application Data

(60) Provisional application No. 62/324,104, filed on Apr. 18, 2016.

(51) Int. Cl.

| | |
|---|---|
| ***F04B 47/00*** | (2006.01) |
| ***E21B 43/12*** | (2006.01) |
| *E21B 34/00* | (2006.01) |
| *E21B 34/08* | (2006.01) |

(52) U.S. Cl.
CPC ..... *E21B 43/123* (2013.01); *E21B 34/08* (2013.01); *E21B 2034/002* (2013.01)

(58) Field of Classification Search
CPC ..... E21B 43/12; E21B 43/121; E21B 43/122; E21B 47/00; E21B 47/12; F04B 47/00; F04B 47/02; F04B 47/12
USPC ..... 417/56; 166/372, 68, 105, 105.2, 105.4
See application file for complete search history.

(56) References Cited

U.S. PATENT DOCUMENTS

| | | | | | |
|---|---|---|---|---|---|
| 1,588,705 | A * | 6/1926 | Cope | F04B 47/00 | 277/336 |
| 1,948,325 | A * | 2/1934 | Anderson | F04B 47/00 | 166/105.2 |
| 1,956,868 | A * | 5/1934 | Lemmon | F04B 53/14 | 417/554 |
| 2,001,012 | A * | 5/1935 | Burgher | E21B 37/04 | 417/60 |
| 2,100,145 | A * | 11/1937 | Moore | E03B 3/12 | 166/157 |
| 2,962,978 | A * | 12/1960 | Reeves | E21B 43/12 | 277/412 |
| 3,801,235 | A * | 4/1974 | Douglas | F16J 15/44 | 277/412 |
| 3,910,730 | A * | 10/1975 | Gage | F04B 53/126 | 417/554 |
| 4,632,647 | A * | 12/1986 | Rowlett | F04B 53/126 | 417/490 |
| 8,448,710 | B1 * | 5/2013 | Stephens | E21B 43/121 | 166/105 |
| 2016/0108710 | A1 * | 4/2016 | Hightower | E21B 43/121 | 166/372 |

* cited by examiner

*Primary Examiner* — Kenneth L Thompson
(74) *Attorney, Agent, or Firm* — MH2 Technology Law Group, LLP

(57) ABSTRACT

A plunger for use in a downhole well includes a body having a bore formed axially-therethrough. An inner surface of the body that defines the bore forms a seat. A stop extends at least partially laterally through the bore. An obstructing member is positioned within the bore and configured to move axially within the bore between the seat and the stop. The obstructing member is configured to prevent fluid flow through the bore in one axial direction when in contact with seat, and to allow fluid flow through the bore in an opposite axial direction when in contact with the obstructing member as the plunger descends in the well.

18 Claims, 5 Drawing Sheets

GAS-LIFT PLUNGER

CROSS-REFERENCE TO RELATED APPLICATIONS

This application claims priority to U.S. Provisional Patent Application having Ser. No. 62/324,104, which was filed on Apr. 18, 2016 and is incorporated herein by reference in its entirety.

BACKGROUND

Gas lift plungers are employed to facilitate the removal of gas from wells, addressing challenges incurred by "liquid loading." In general, a well may produce both liquid and gaseous elements. When gas flow rates are high, the gas carries the liquid out of the well as the gas rises. However, as the pressure in the well decreases, the flowrate of the gas decreases to a point below which the gas fails to carry the heavier liquids to the surface. The liquids thus fall back to the bottom of the well, exerting back pressure on the formation, and thereby loading the well.

Plungers alleviate such loading by assisting in removing liquid and gas from the well, e.g., in situations where the ratio of liquid to gas is high. For example, the plunger is introduced into the top of the well. One type of plunger includes a valve that is initially in an open position. When the valve is in the open position, the plunger descends through a tubing string in the well toward the bottom of the well. Once the plunger reaches the bottom of the well, the valve is closed. A compressed gas is then introduced into the well, below the plunger. The compressed gas lifts the plunger within the tubing string, causing any liquids above the plunger to be raised to the surface.

SUMMARY

A plunger for use in a downhole well is disclosed. The plunger includes a body having a bore formed axially-therethrough. An inner surface of the body that defines the bore forms a seat. A stop extends at least partially laterally through the bore. An obstructing member is positioned within the bore and configured to move axially within the bore between the seat and the stop. The obstructing member is configured to prevent fluid flow through the bore in one axial direction when in contact with seat, and to allow fluid flow through the bore in an opposite axial direction when in contact with the obstructing member as the plunger descends in the well.

In another embodiment, the plunger includes a body including one or more tube-engaging structures extending radially-therefrom. The body defines a bore formed axially-therethrough, and an inner surface of the body that defines the bore forms a seat. A stop extends at least partially laterally through the bore. An obstructing member is positioned within the bore and configured to move axially-within the bore between the seat and the stop. The obstructing member prevents fluid flow through the bore in one axial direction when in contact with the seat while the plunger is ascending in the well, and the obstructing member is separated from the seat and allows fluid flow through the bore when the plunger is descending in the well.

A method for producing gas from a well is also disclosed. The method includes deploying a plunger into the well. When the plunger descends in the well, fluid flow proceeds through a bore defined through the plunger and around an obstructing member held in the bore by a stop extending laterally-into the bore. When the plunger ascends in the well, fluid flow is prevented from proceeding through the bore by the obstructing member engaging a seat defined within the plunger.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

Figure 1:
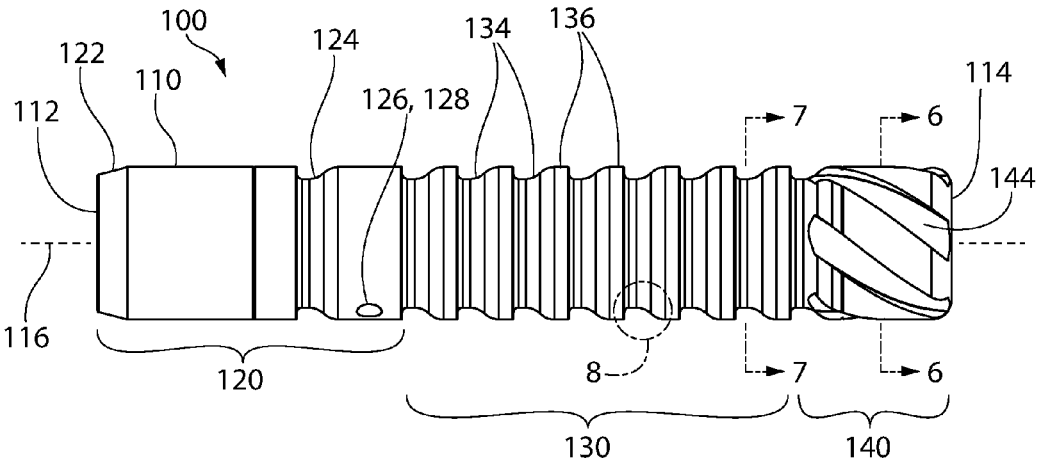
FIG. 1 illustrates a side view of a plunger, according to an embodiment.

It should be noted that some details of the figure have been simplified and are drawn to facilitate understanding of the embodiments rather than to maintain strict structural accuracy, detail, and scale.

DETAILED DESCRIPTION

In general, embodiments of the present disclosure may provide a plunger. The plunger may be a gas-lift plunger for use in a well. The plunger may include a body having a bore formed axially-therethrough. An inner surface of the body that defines the bore may form a seat. A stop, such as a rod, may be positioned in the bore. An obstructing member, such as a ball, may be positioned within the bore and configured to move axially-within the bore between the seat and the stop. The obstructing member may prevent fluid flow through the bore in one axial direction when in contact with the seat, and may allow fluid flow in an opposite axial direction, e.g., when in contact with the stop. The stop prevents the obstructing member from exiting from within the bore. Additional details related to the specific embodiments, potentially including several optional features, are described below.

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration one or more specific example embodiments in which the present teachings may be practiced.

Further, notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

FIG. 1 illustrates a side view of a plunger 100, according to an embodiment. The plunger 100 may include a substantially cylindrical body 110 having a first (e.g., upper) end 112 and a second (e.g., lower) end 114. The body 110 may be or include one integral component or multiple components that are coupled together. The body 110 may include an upper portion 120, an intermediate portion 130, and a lower portion 140. The upper portion 120 may include the upper end 112, and the lower portion 140 may include the lower end 114.

The plunger 100 may also include a stop 128, which is configured to engage an obstructing member (described below) and prevent the obstructing member from exiting from within the body 110, e.g., out of the upper end 112. The stop 128 may take any one of many forms, such as a rod, a pin, a bar (e.g., having a polygonal cross-section), one or more protrusions extending inwards into the bore, etc., such that the stop 128 is capable of preventing the obstructing member from passing by, but allows fluid to flow through the bore. In the illustrated embodiment, the stop 128 is formed as a rod that extends through a lateral bore 126 drilled into, e.g., through the body 110. As shown, the lateral bore 126 and the stop 128 may be positioned in the upper portion 120. In another embodiment, the lateral bore 126 and the stop 128 may be positioned in the intermediate portion 130.

The upper portion 120 may include a tapered outer surface 122. A diameter of the tapered outer surface 122 may decrease proceeding toward the upper end 112. The tapered outer surface 122 may be oriented at an angle from about 5° to about 25° or about 10° to about 20° (e.g., about 15°) with respect to a central longitudinal axis 116 through the body 110. The tapered outer surface 122 may help the plunger 100 remain aligned in a tubular (e.g., a tubing string in a wellbore) as the plunger 100 ascends through a fluid in the tubular. The upper portion 120 may also include one or more first circumferential grooves (one is shown: 124) formed in the outer surface thereof.

The intermediate portion 130 may include a plurality of tube-engaging structures 136 (e.g., wipers, pads, brushes, etc.) configured to engage a surrounding tubular (e.g., production tubing) and prevent fluid flow around the exterior of the plunger 100. The tube-engaging structures 136 may be separated axially-apart by a plurality of second circumferential grooves 134 formed in the outer surface thereof. In an embodiment, the tube-engaging structures 136 may be as illustrated in U.S. Pat. No. D767,737, which is incorporated herein by reference in its entirety.

The lateral bore 126 and the stop 128 may be positioned axially-between the first circumferential groove 124 and the second circumferential grooves 134. The second circumferential grooves 134 may be axially-offset from one another with respect to the central longitudinal axis 116 through the body 110. The second circumferential grooves 134 are described in greater detail below with respect to FIG. 8.

The lower portion 140 may include one or more substantially helical grooves (five are shown: 144) formed in the outer surface thereof. A central axis through each of the helical grooves 144 may be oriented at an angle with respect to the central longitudinal axis 116 through the body 110 from about 10° to about 50° or about 20° to about 40° (e.g., a 30° sweep). The helical grooves 144 may cause the plunger 100 to rotate about its central longitudinal axis 116 when the plunger 100 descends through the fluid in the tubular.

Figure 2:
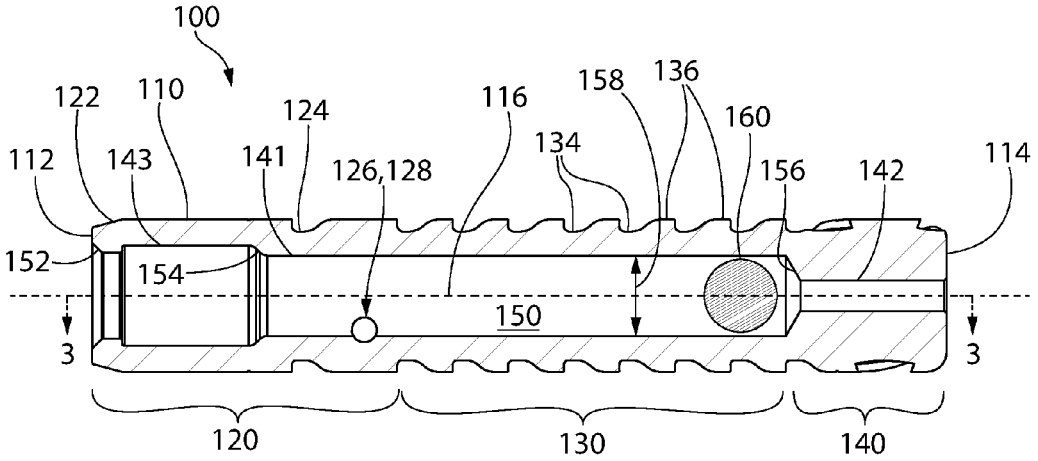
FIG. 2 illustrates a cross-sectional side view of the plunger, according to an embodiment.
Figure 3:
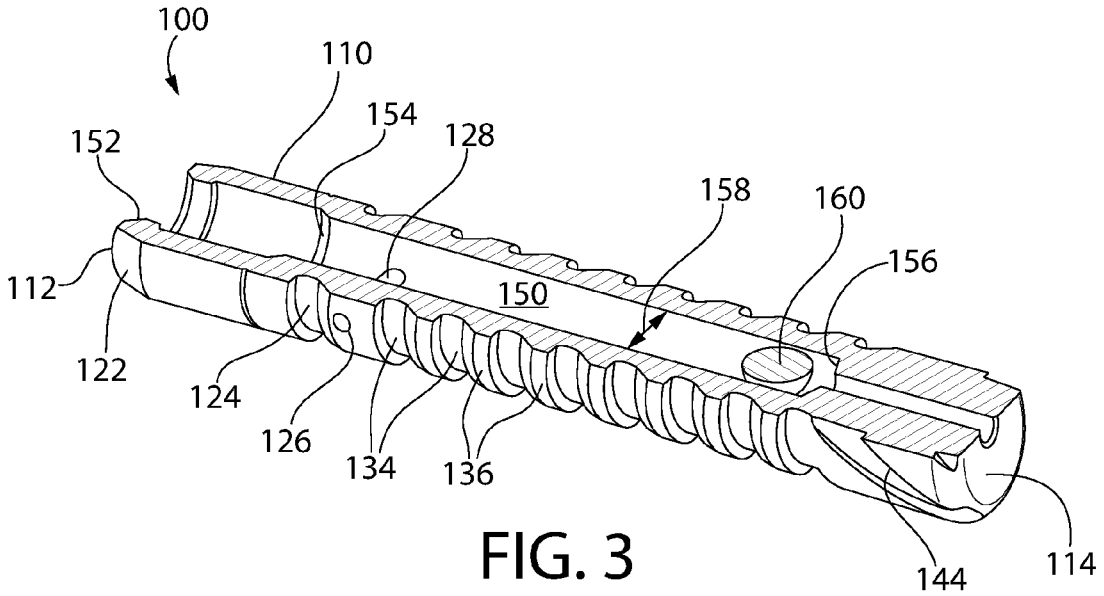
FIG. 3 illustrates a half-sectional perspective view of the plunger, according to an embodiment.

FIGS. 2 and 3 illustrate a cross-sectional side view and a half-sectional perspective view, respectively, of the plunger 100, according to an embodiment. The body 110 may have an axial bore 150 formed therethrough. The bore 150 may include a first portion 141 and a second portion 142, with the second portion 142 having a smaller diameter than the first portion 141. In some applications, the second portion 142 may be considered a fluid flow port. The first portion 141 may extend from a fishing neck 143 defined in the body 110, e.g., in the first portion 120. The first portion 141 may extend through at least a part of the upper portion 120 of the body 110 and the intermediate portion 130 thereof.

An inner surface of the body 110 that defines the bore 150 may form a seat 156. The seat 156 may be positioned in the intermediate portion 130 of the body 110 or the lower portion 140 of the body 110. The seat 156 may form the transition between the first and second portions 141, 142 of the bore 150. Further, the seat 156 may be axially-aligned with one of the second circumferential grooves 134 (e.g., the lowermost second circumferential groove 134). In another embodiment, the seat 156 may be axially-aligned with the helical grooves 144. It will be appreciated that the seat 156 being "axially-aligned" with the second circumferential groove 134 or the helical grooves 144 refers the position of the seat 156 along the central axis of the body 110 being the same as at least a part of the respective one of the grooves 134, 144.

As mentioned above, an obstructing member (e.g., a spherical ball) 160 may be positioned within the bore 150. The obstructing member 160 may be configured to move axially-within the bore 150 between the stop (e.g., the stop 128) and the seat 156. When fluid flows through the bore 150 in an upward direction (e.g., from the second end 114 toward the first end 112), the obstructing member 160 may rest against the stop 128, which prevents the obstructing member 160 from exiting the bore 150. When the obstructing member 160 rests against the stop 128, the fluid may flow around the obstructing member 160 and out of the bore 150 through the upper end 112 of the body 110, as described in greater detail below. When fluid flows through the bore 150 in a downward direction (e.g., from the first end 112 toward the second end 114), the obstructing member 160 may rest against the seat 156. When the obstructing member 160 rests against the seat 156, the obstructing member 160 may form a seal against the seat 156, preventing (or at least substantially preventing) the fluid from flowing through the seat 156 in the downward direction. As shown, in one embodiment, the portion of the bore 150 in which the obstructing member 160 may move between stop 128 and the seat 156 the may have a substantially constant diameter 158.

The obstructing member 160 may be made from the same material as the body 110. In another embodiment, the obstructing member 160 may be made from a different material than the body 110, e.g., with the obstructing member 160 being made at least partially from a material having a higher density than the material of the body 100. This may facilitate the obstructing member 160 remaining in the seat 156. The density of the obstructing member 160 and the body 100 may be selected based upon wellbore conditions, such as the amount of fluid and/or gas in the well (in order to optimize the removal of gas from the well). In an embodiment, the body 110 may be made from titanium, while the obstructing member 160 may be made from stainless steel or tungsten carbide. It will be appreciated that these materials are merely examples and a variety of suitable materials or combinations of materials could be used for either or both of the body 110 and the obstructing member 160.

The body 110 may include one or more tapered inner surfaces (three are shown: 152, 154, 156) that at least partially define the bore 150. The first and second tapered inner surfaces 152, 154 may be positioned within the upper portion 120. A diameter of the first tapered inner surface 152 may increase proceeding toward the upper end 112. The first tapered inner surface 152 may be oriented at an angle from about 25° to about 65° or about 35° to about 55° (e.g., about 45°) with respect to the central longitudinal axis 116 through the body 110. The second tapered inner surface 154 may be positioned below the first tapered inner surface 152. A diameter of the second tapered inner surface 154 may also increase proceeding toward the upper end 112. The second tapered inner surface 154 may be oriented at an angle from about 25° to about 65° or about 35° to about 55° (e.g., about 45°) with respect to the central longitudinal axis 116 through the body 110. The seat 156 may be the third tapered inner surface. A diameter of the seat 156 may also increase proceeding toward the upper end 112.

Figure 4:
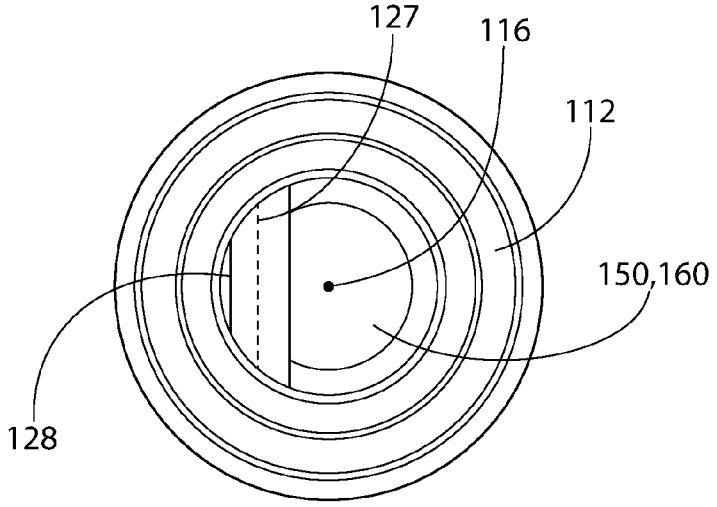
FIG. 4 illustrates a view of a first (e.g., upper) end of the plunger, according to an embodiment.

FIG. 4 illustrates an axial end view of the upper end 112 of the plunger 100, according to an embodiment. As shown, a central longitudinal axis 127 through the stop 128 may be radially-offset from (e.g., skew or otherwise non-intersecting to) the central longitudinal axis 116 through the body 110. This offset location may increase the structural integrity of the stop 128 by reducing the length of the stop 128 that extends unsupported through the bore 150. As shown, the stop 128 may be oriented generally tangential to, or parallel to a tangent to, the inner surface of the body 110. In another embodiment, the central longitudinal axis 127 through the stop 128 may intersect the central longitudinal axis 116 through the body 110.

Figure 5:
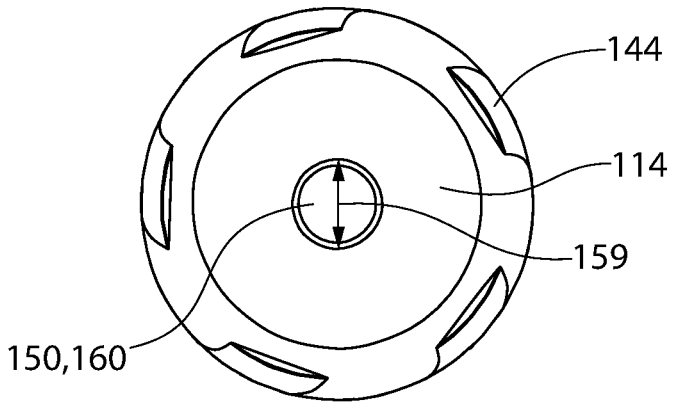
FIG. 5 illustrates a view of a second (e.g., lower) end of the plunger, according to an embodiment.
Figure 6:
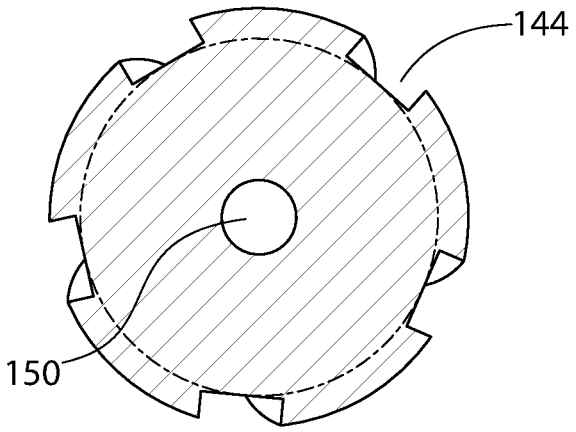
FIG. 6 illustrates a cross-sectional view of the plunger taken through line 6-6 in FIG. 1, according to an embodiment.

FIG. 5 illustrates a view of the lower end 114 of the plunger 100, and FIG. 6 illustrates a cross-sectional view of the plunger 100 taken through line 6-6 in FIG. 1, according to an embodiment. The helical grooves 144 may be circumferentially-offset from one another (e.g., by about 72°). As shown in FIGS. 2 and 5, the bore 150 may have a first diameter 158 between the stop 128 and the seat 156, and the bore 150 may have a second diameter 159 in the lower portion 140 (e.g., in the lower end 114). The first diameter 158 may be greater than the second diameter 159. The first diameter 158 may be greater than a diameter 162 of the obstructing member 160, and the second diameter 159 may be less than the diameter 162 of the obstructing member 160. In at least one embodiment, a ratio of the second diameter 159 of the bore 150 to the diameter 162 of the obstructing member 160 may be from about 1:1.5 to about 1:2.33. It will be appreciated that deviations from these ratios are conceivable. For example, the second diameter 159 may be reduced as compared to the obstructing member 160, which may promote the obstructing member 160 remaining seated in the seat 156, but may slow the descent of the plunger 100 in the well. On the other hand, the second diameter 159 can be increased with respect to the obstructing member 160, which may hasten the descent but may introduce a tendency for the obstructing member 160 to unseat on the way to surface. The diameters 158, 159 may be selected based upon wellbore conditions, such as the amount of fluid and/or gas in the well (in order to optimize the removal of gas from the well). The diameter 158 and the diameter of the obstructing member 160 may be selected based upon wellbore conditions, such as the amount of fluid and/or gas in the well (in order to optimize the removal of gas from the well.

Figure 7:
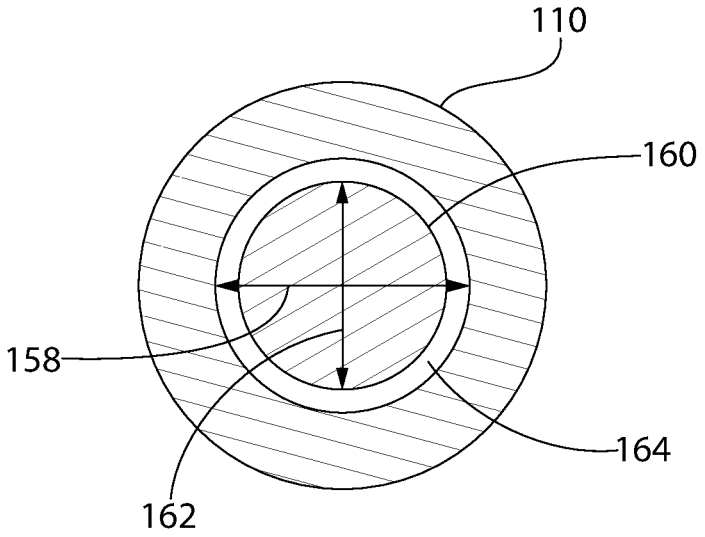
FIG. 7 illustrates a cross-sectional view of the plunger taken through line 7-7 in FIG. 1, according to an embodiment.

FIG. 7 illustrates a cross-sectional view of the plunger 100 taken through line 7-7 in FIG. 1, according to an embodiment. An annulus 164 may be formed radially-between the obstructing member 160 and the inner surface of the body 110 that defines the bore 150. A ratio of the diameter 162 of the obstructing member 160 to the first diameter 158 of the bore 150 (e.g., between the stop 128 and the seat 156) may range from about 0.75:1.00 to about 0.91:1.00. In one example, the outer diameter of the obstructing member 160 may be 0.75 inches, and the diameter of the bore 150 may be 1.00 inches. In another example, the outer diameter of the obstructing member 160 may be 0.88 inches, and the diameter of the bore 150 may be 1.00 inch. In yet another example, the outer diameter of the obstructing member 160 may be 1.13 inches, and the diameter of the bore 150 may be 1.25 inches.

Figure 8:
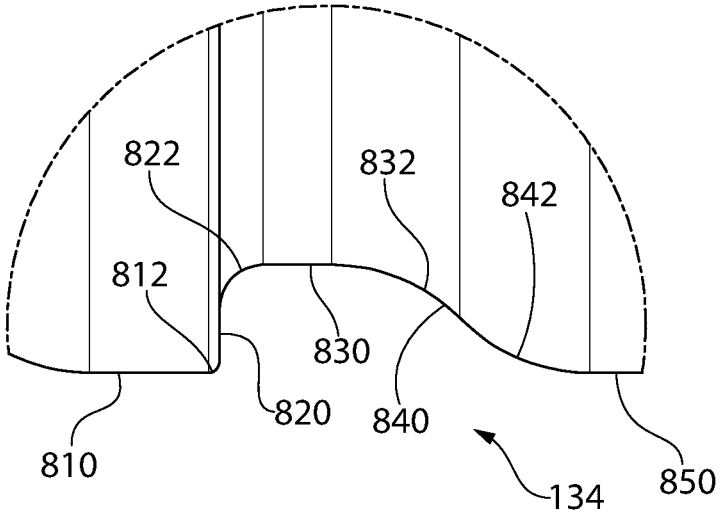
FIG. 8 illustrates an enlarged side view of a portion of the plunger identified in FIG. 1, according to an embodiment.

FIG. 8 illustrates an enlarged side view of a portion of the plunger 100 identified in FIG. 1, according to an embodiment. More particularly, FIG. 8 illustrates one of the second circumferential grooves 134. The first circumferential groove 124 may be the same as or different from the second circumferential grooves 134. The outer surface of the body 110 may transition from a first portion 810 that is substantially parallel to the central longitudinal axis 116 through the body 110 to a second portion 820 that is substantially perpendicular to the central longitudinal axis 116 through the body 110. The transition may include a first curvature 812 (e.g., a radius of 0.015 or 0.02 inches). The second portion 820 may then transition to a third portion 830 that is substantially parallel to the central longitudinal axis 116 through the body 110. The transition may include a second curvature 822 (e.g., a radius of 0.06 inches). The third portion 830 may then transition to a fourth portion 840 that is oriented at an angle from about 30° to about 60° or about 40° to about 50° (e.g., about 45°) with respect to the central longitudinal axis 116 through the body 110. The transition may include a third curvature 832 (e.g., a radius of 0.25 inches). The fourth portion 840 may then transition to a fifth portion 850 that is substantially parallel to the central longitudinal axis 116 through the body 110. The transition may include a fourth curvature 842 (e.g., a radius of 0.25 inches).

In operation, the plunger 100 may be introduced into the well from the surface. As the plunger 100 descends in the well, the fluid in the well may flow upward into the bore 150 of the body 110 through the lower end 114 thereof, causing the obstructing member 160 to unseat from the seat 156 and move upward in the bore 150 toward the stop 128. The stop 128 may prevent the obstructing member 160 from moving out of the bore 150 through the upper end 112 of the body 110, while also allowing the fluid to flow around the obstructing member 160 when the obstructing member 160 in contact with the stop 128. Once the obstructing member 160 is unseated from the seat 156, the fluid may flow around the obstructing member 160 (e.g., through the annulus 164) and out of the bore 150 through the upper end 112. This may substantially decrease the shut-in time of the well. The user may control the rate that the plunger 100 descends in the well by varying the diameters 158, 159 of the bore 150 and/or the diameter 162 of the obstructing member 160.

When the plunger 100 reaches bottom of the well, the obstructing member 160 may descend in the bore 150, relative to the body 110 and seat on the seat 156, trapping fluid above it. When the well is opened back up, the pressure below the plunger 100 may be greater than the pressure above the plunger 100. Thus, the upward force exerted on the plunger 100 by the fluid below the plunger 100 may be greater than the downward force exerted on the plunger 100 by the fluid above the plunger 100. As a result, the plunger 100 may begin ascending in the well. The pressure of the fluid above the obstructing member 160, however, may be greater than the pressure of the fluid below the obstructing member 160. Thus, the downward force exerted on the obstructing member 160 by the fluid above the obstructing member 160 may be greater than the upward force exerted on the obstructing member 160 by the fluid below the obstructing member 160. As a result, the obstructing member 160 may remain seated on the seat 156 as the plunger 100 ascends.

If or when the ascension of the plunger 100 in the well stalls out, the obstructing member 160 may unseat from the seat 156 and move upward within the bore 150 toward the stop 128. This may allow a portion of the fluid (e.g., gas) in the well to flow upward through the plunger 100. This may lighten the fluid above the plunger 100, thereby decreasing the downward force exerted on the plunger 100 by the fluid above the plunger 100. As a result, the plunger 100 may continue ascending in the well.

The user may control the rate that the plunger 100 ascends in the well by varying the diameters 158, 159 of the bore 150 and/or the diameter 162 of the obstructing member 160 to prevent the plunger 100 from stalling or descending when the obstructing member 160 unseats from the seat 156. Rather, the plunger 100 may still ascend toward surface, just at a slower rate than when the obstructing member 160 is seated in the seat 156. This configuration of the plunger 100 allows the user to continue to produce the fluid when a standard conventional plunger may stall out and not unload the fluid.

Figure 9:
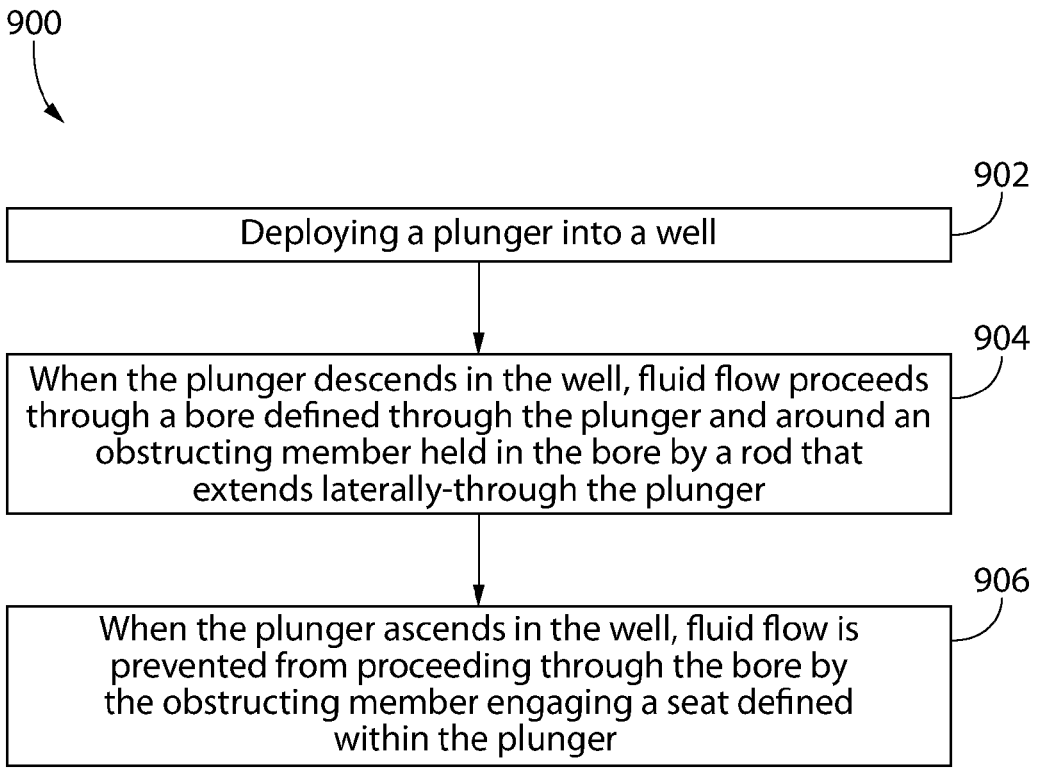
FIG. 9 illustrates a flowchart of a method for producing gas from a well, according to an embodiment.

FIG. 9 illustrates a flowchart of a method 900 for producing gas from a well, according to an embodiment. The method 900 may be executed by operation of one or more embodiments of the plunger 100 discussed above. Accordingly, the method 900 may be understood with reference thereto; however, it will be appreciated that at least some embodiments may be executed by operation of other plungers, and thus the method 900 is not limited to any particular structure unless otherwise stated herein.

The method 900 may include deploying a plunger 100 into a well, as at 902. When the plunger 100 descends in the well, fluid flow may proceed through a bore 150 defined through the plunger 100 and around an obstructing member 160 held in the bore 150 by a stop 128 that extends laterally-through the plunger 100, as at 904. When the plunger 100 reaches the bottom of its range of travel, the obstructing member 160 engages the seat 156 and blocks fluid flow. Pressure then builds below the plunger 100, eventually causing the plunger 100 to ascend in the well. When the plunger 100 ascends in the well, fluid flow may be prevented (or at least substantially prevented) from proceeding through the bore 150 by the obstructing member 160 engaging a seat 156 defined within the plunger 100, as at 906.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A plunger for use in a downhole well, comprising:

a body having a bore formed axially-therethrough, wherein an inner surface of the body that defines the bore forms a seat;

a stop extending at least partially laterally through the bore; and an obstructing member positioned within the bore and configured to move axially within the bore between the seat and the stop, wherein the obstructing member is configured to prevent fluid flow through the bore in one axial direction when in contact with seat, and to allow fluid flow through the bore in an opposite axial direction when in contact with the obstructing member as the plunger descends in the well, wherein the body comprises a plurality of circumferentially-offset helical grooves defined in an outer surface of the body, and wherein the seat is axially-aligned with the helical grooves.

2. The plunger of claim 1, wherein the stop comprises a rod extending at least partially laterally through the body.

3. The plunger of claim 1, wherein a central longitudinal axis through the stop is offset from a central longitudinal axis through the body.

4. The plunger of claim 1, wherein the stop is tangential to the inner surface of the body.

5. The plunger of claim 1, wherein the outer surface of the body comprises a plurality of axially-offset circumferential grooves, and wherein the seat is axially-aligned with a lowermost one of the circumferential grooves.

6. The plunger of claim 1, wherein the obstructing member comprises a spherical ball.

7. The plunger of claim 1, wherein a ratio of a diameter of the obstructing member to a first diameter of the bore between the stop and the seat is from about 1:1.08 to about 1:1.35.

8. The plunger of claim 7, wherein a ratio of a second diameter of the bore in a lower end of the body to the diameter of the obstructing member is from about 1:1.5 to about 1:2.33.

9. A plunger for use in a downhole well, comprising:

a body having a bore formed axially-therethrough, wherein an inner surface of the body that defines the bore forms a seat;

a stop extending at least partially laterally through the bore; and an obstructing member positioned within the bore and configured to move axially within the bore between the seat and the stop, wherein the obstructing member is configured to prevent fluid flow through the bore in one axial direction when in contact with seat, and to allow fluid flow through the bore in an opposite axial direction when in contact with the obstructing member as the plunger descends in the well, wherein the body comprises:

a first tapered inner surface proximate to an upper end of the body that has a diameter that increases proceeding toward the upper end of the body; and a second tapered inner surface positioned axially-between the first tapered inner surface and the obstructing member, wherein a diameter of the second tapered inner surface increases proceeding toward the upper end of the body.

10. The plunger of claim 9, wherein fluid flow through the bore is permitted when the obstructing member contacts the stop, the stop being configured to prevent the obstructing member from exiting out of the bore of the body.

11. The plunger of claim 9, wherein the body comprises one or more tube-engaging structures that comprise a plurality of wipers extending outward from the body, the plurality of wipers being separated axially-apart by a plurality of grooves defined in an outer surface of the body.

12. The plunger of claim 9, wherein the obstructing member comprises a spherical ball, and wherein the seat comprises a third tapered inner surface of the body.

13. The plunger of claim 9, wherein the stop comprises a rod that extends laterally at least partially through the body.

14. The plunger of claim 13, wherein the rod is at least partially in contact with the body along an entire length of the rod.

15. The plunger of claim 13, wherein a central longitudinal axis through the rod is offset from a central longitudinal axis through the body.

16. A method for producing gas from a well, comprising:

deploying a plunger into the well, wherein:

when the plunger descends in the well, fluid flow proceeds through a bore defined through a body of the plunger and around an obstructing member held in the bore by a stop extending laterally-into the bore, when the plunger ascends in the well, fluid flow is prevented from proceeding through the bore by the obstructing member engaging a seat defined by an inner surface of the body that defines the bore in the plunger, and the body comprises a plurality of circumferentially-offset helical grooves defined in an outer surface of the body, and wherein the seat is axially-aligned with the helical grooves.

17. The method of claim 16, wherein the stop comprises a rod that is oriented so as to be skew to a central longitudinal axis of the plunger, and wherein the rod extends parallel to a line drawn tangent to an inner surface of the plunger that defines the bore.

18. The method of claim 16, wherein the plunger comprises one or more tube-engaging structures configured to prevent fluid flow around an outer surface of the plunger.

* * * * *